United States Patent [19]

Steele

[11] 4,307,688

[45] Dec. 29, 1981

[54] DIESEL ENGINE GLOW PLUG ENERGIZATION CONTROL SYSTEM

[75] Inventor: Robert E. Steele, Cortland, Ohio

[73] Assignee: General Motors Corporation, Detroit, Mich.

[21] Appl. No.: 119,352

[22] Filed: Feb. 7, 1980

[51] Int. Cl.[3] ..... F02P 19/02

[52] U.S. Cl. ..... 123/179 BG; 123/179 H

[58] Field of Search ..... 123/179 BG, 179 B, 179 H, 123/145 A; 361/264, 265

[56] References Cited

U.S. PATENT DOCUMENTS

| | | | |
|---|---|---|---|
| 3,060,298 | 10/1962 | Swanson | 219/20 |
| 3,187,164 | 6/1965 | Andrick | 219/504 |
| 3,400,252 | 9/1968 | Hayakawa et al. | 219/504 |
| 3,577,209 | 5/1971 | Perkins | 317/98 |
| 3,826,924 | 7/1974 | Plough et al. | 307/117 |
| 4,088,109 | 5/1978 | Woodruff et al. | 123/179 H |
| 4,137,885 | 2/1979 | Van Ostrom | 123/179 BG |

FOREIGN PATENT DOCUMENTS

| | | | |
|---|---|---|---|
| 2743059 | 4/1979 | Fed. Rep. of Germany | 123/179 H |
| 47-30068 | 8/1972 | Japan | 123/179 H |
| 54-151739 | 11/1979 | Japan | 123/145 A |

OTHER PUBLICATIONS

"Indirect Electroheat Regulation", proceedings of IEE, vol. 116, No. 8, Aug. 1969, Roots and Gönenc, pp. 1471–1474.

Thermistor Applications, pp. 49–51.

Keystone Thermistors.

Keystone Positive Temperature Coefficient Thermistors, pp. 1–11.

Electronic Design–vol. 25, No. 23, Nov. 8, 1977.

*Primary Examiner*—Charles J. Myhre

*Assistant Examiner*—Andrew M. Dolinar

*Attorney, Agent, or Firm*—Richard G. Stahr

[57] ABSTRACT

A positive temperature coefficient resistor element of the type that has a substantially constant resistance value when the temperature thereof is less than a selected value and that displays a rapid rise in resistance value when the temperature thereof reaches and increases beyond the selected value is mounted in thermal communication with a Diesel engine and is arranged to be electrically energized and deenergized simultaneously with the engine glow plug energizing circuit. An associated electrical switching arrangement is effective to complete the respective glow plug and resistor element energizing circuits across an operating potential source in response to the application of operating potential and, thereafter, is effective to alternately interrupt and complete the respective glow plug and resistor element energizing circuits in response to the electrical signal developed across the resistor element attaining a predetermined potential level and in response to the electrical signal developed across the resistor element attaining another predetermined potential level, respectively, to cyclically complete and interrupt the glow plug energizing circuit.

5 Claims, 10 Drawing Figures

DIESEL ENGINE GLOW PLUG ENERGIZATION CONTROL SYSTEM

This invention is directed to a Diesel engine glow plug energization control system and, more specifically, to a Diesel engine glow plug energization control system that cyclically completes and interrupts a glow plug energizing circuit in response to the electrical signal developed across a simultaneously energized and de-energized positive temperature coefficient resistor element attaining a predetermined potential level while energized and in response to the electrical signal developed across the positive temperature coefficient resistor element attaining another predetermined potential level while not energized.

To facilitate Diesel engine starting, especially with cold ambient temperatures, the combustion chamber of each of the engine cylinders is generally preheated by an electrically energized glow plug adapted to be threaded into the engine block in communication with the combustion chamber. Upon the electrical energization thereof, the temperature of each of the glow plug heater elements is raised to preheat the corresponding combustion chamber prior to engine "Crank". The period of time of glow plug heater element energization prior to engine "Crank", the preheat period, is determined by engine temperature and glow plug heater element energization potential magnitude, the lower the temperature and/or the lower the glow plug heater element energization potential magnitude, the longer the preheat period required. With many glow plug energization control systems, the glow plug heater elements are energized at rated energizing potential. Although this rated glow plug heater element energization potential prevents premature failure as a result of overheating, the period of preheat before engine "crank" may be of the order of one or two minutes or longer with colder ambient temperatures. To substantially reduce the preheat period, the glow plug heater elements may be energized at greater than rated energizing potential. With glow plug heater element energization at greater than rated potential, however, it is necessary that the heater elements by cyclically energized for successive periods of time just long enough to increase the temperature thereof to a predetermined maximum. Respective systems of this type are disclosed and described in U.S. Pat. No. 4,137,885 Van Ostrom, Feb. 6, 1979, and U.S. Pat. No. 4,177,785 Sundeen, Dec. 11, 1979, both of which are assigned to the same assignee as is this invention. In the U.S. Pat. No. 4,137,885, the cyclical control of glow plug energization is controlled by an R-C time constant network arranged to simulate glow plug temperature and in the U.S. Pat. No. 4,177,785, the cyclical control of glow plug energization is determined by a bimetal thermostatic switch in heat-transfer communication with the engine. A particular disadvantage of the glow plug control system using an R-C time constant network is that the network in and of itself is not responsive to engine temperature but depends upon a change of resistance valve of a separately mounted thermistor element in heat-transfer relationship with the engine. Disadvantages of the glow plug control system using a bimetal thermostatic switch are (1) the bimetal element is not self-heating; (2) a mechanical hold-in is required to supply hysteresis during the period of glow plug deenergization; and (3) it is difficult to maintain an accurate switching temperature.

Therefore, a Diesel engine glow plug energization control system that obviates the disadvantages of the systems disclosed in these United States patents by effecting the cyclical control of the engine glow plug energizating circuit by a circuit element that is responsive to both engine temperature and to the self-heating effect as a result of energizing current flow therethrough; by eliminating the need for providing a mechanical hysteresis arrangement and by maintaining a very accurate switching temperature, is desirable.

It is therefore an object of this invention to provide an improved Diesel engine glow plug energization control system.

It is another object of this invention to provide an improved Diesel engine glow plug energization control system wherein a thermally responsive resistor element effects the cyclical energization and deenergization of the glow plug energizing circuit.

In accordance with this invention, a Diesel engine glow plug energization and deenergization control system is provided wherein a positive temperature coefficient resistor element and a glow plug energizing circuit are simultaneously electrically energized and deenergized by an electrically operable switching arrangement that is effective to complete respective glow plug and resistor element energization circuits across an operating potential source in response to the application of operating potential and, thereafter, is effective to cyclically interrupt and complete the respective glow plug and resistor element energizing circuits in response to the potential signal developed across the resistor element attaining a predetermined magnitude while energized and in response to the potential signal developed across the resistor element attaining a second different predetermined magnitude while deenergized.

For a better understanding of the present invention, together with additional objects, advantages and features thereof, reference is made to the following description and accompanying drawing in which:

FIG. 1 sets forth partially in schematic and partially in block form a portion of the Diesel engine glow plug energization control system of this invention;

FIG. 2 sets forth partially in schematic and partially in block form another portion of the Diesel engine glow plug energization control system of this invention;

FIG. 3 sets forth partially in schematic and partially in block form a typical Diesel engine electrical system and glow plug energization circuit with which the glow plug energization control system of this invention may be employed;

FIG. 4 sets forth in schematic form certain interrelated portions of the circuitry set forth in FIGS. 1, 2, and 3;

FIG. 5 is a set of curves useful in understanding the operation of the circuitry set forth in FIGS. 1, 2 and 4;

FIG. 6 sets forth in schematic form an alternate embodiment of the circuitry of FIG. 1;

FIG. 7 sets forth in schematic form certain interrelated portions of the circuitry of FIGS. 1, 3 and 6;

Figure 1:
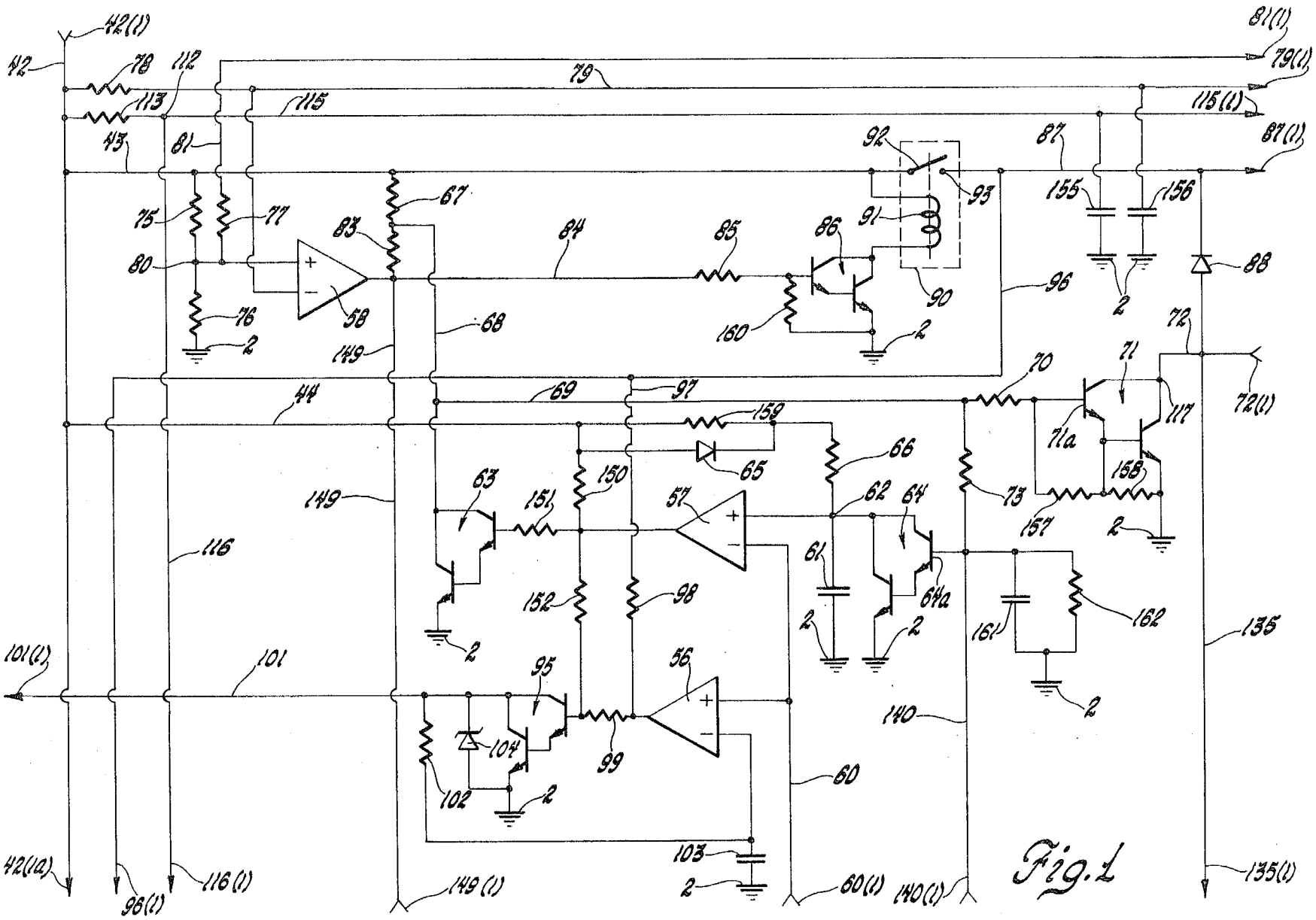

The Diesel engine glow plug energization control system of this invention employs eight conventional voltage comparator circuit elements. As these circuit elements may be commercially available items well known in the art and, per se, form no part of this invention, these devices are illustrated in block form in the drawing and are identified by the reference numerals 51, 52, 53, 54, 55, 56, 57 and 58. Furthermore, these devices are only examples of circuit elements suitable for use with the system of this invention, consequently, there is no intention or inference of a limitation thereto as other circuit elements having similar electrical characteristics may be substituted therefor without departing from the spirit of the invention. One example of a commercially available voltage comparator circuit suitable for use with the system of this invention is of the type marketed by National Semiconductor Corporation of Santa Clara, Calif., under the designation LM 2901. The output terminal of an LM 2901 voltage comparator circuit is the uncommitted collector electrode of a grounded emitter output NPN transistor. With a potential signal applied to the plus (+) input terminal of an LM 2901 voltage comparator circuit of a level greater than that of the potential signal applied to the minus (−) input terminal, the device is operated to the condition in which the output NPN transistor is not conductive and with a potential signal applied to the minus (−) input terminal of a level greater than that of the potential signal applied to the plus (+) input terminal, the device is operated to the condition in which the output NPN transistor is conductive to place the output terminal at substantially ground potential. These devices, therefore, can only "sink" current but are incapable of supplying current. Throughout the remainder of this specification, a reference to any one of these voltage comparator circuits being "Off" means that the output NPN transistor thereof is not conductive and a reference to any one of these voltage comparator circuits being "On" means that the output NPN transistor thereof is conductive.

As point of reference or ground potential is the same point electrically throughout the system, it is represented in the drawing by the accepted schematic symbol and reference by the numeral 2.

Figure 2:
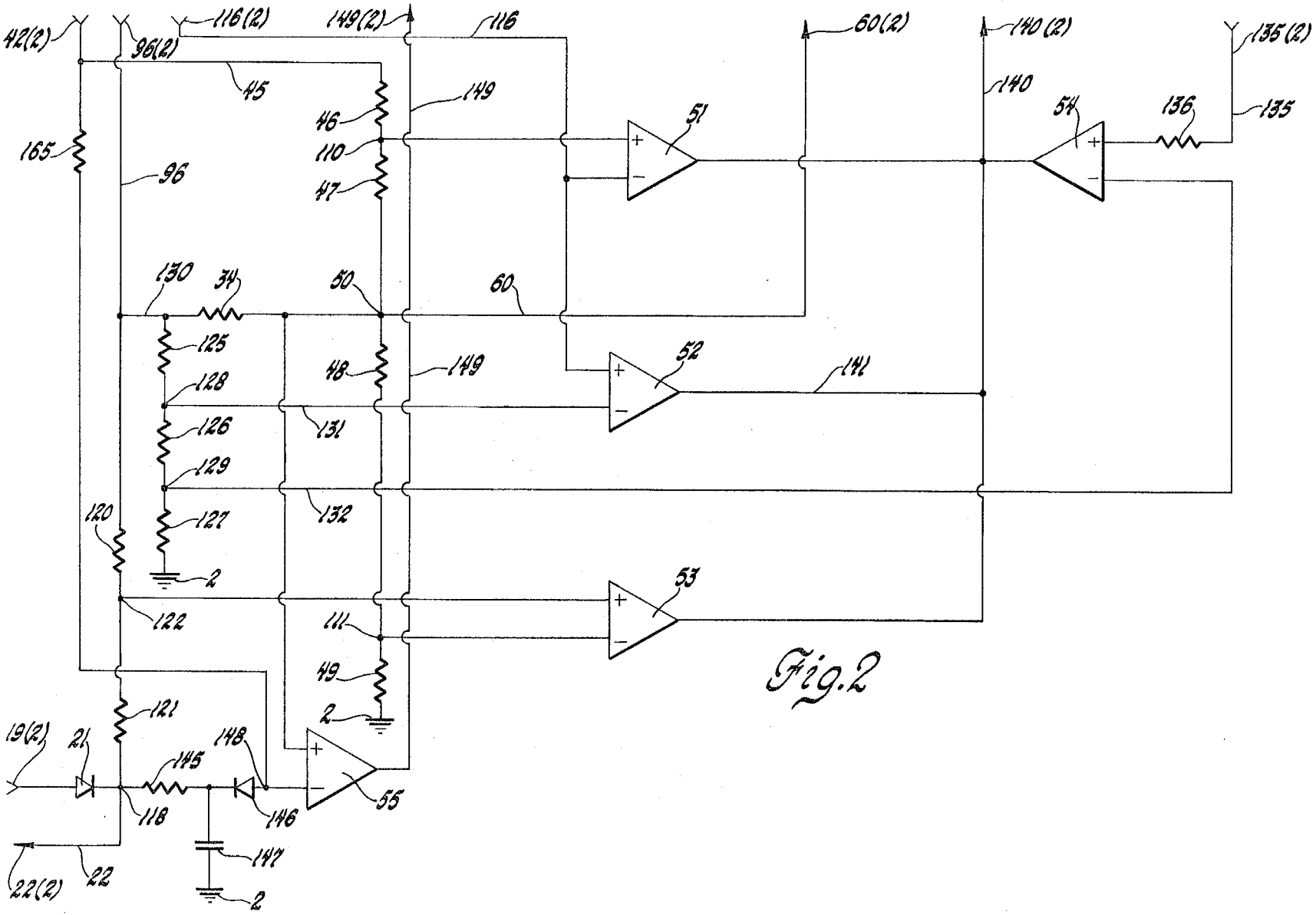
Figure 3:
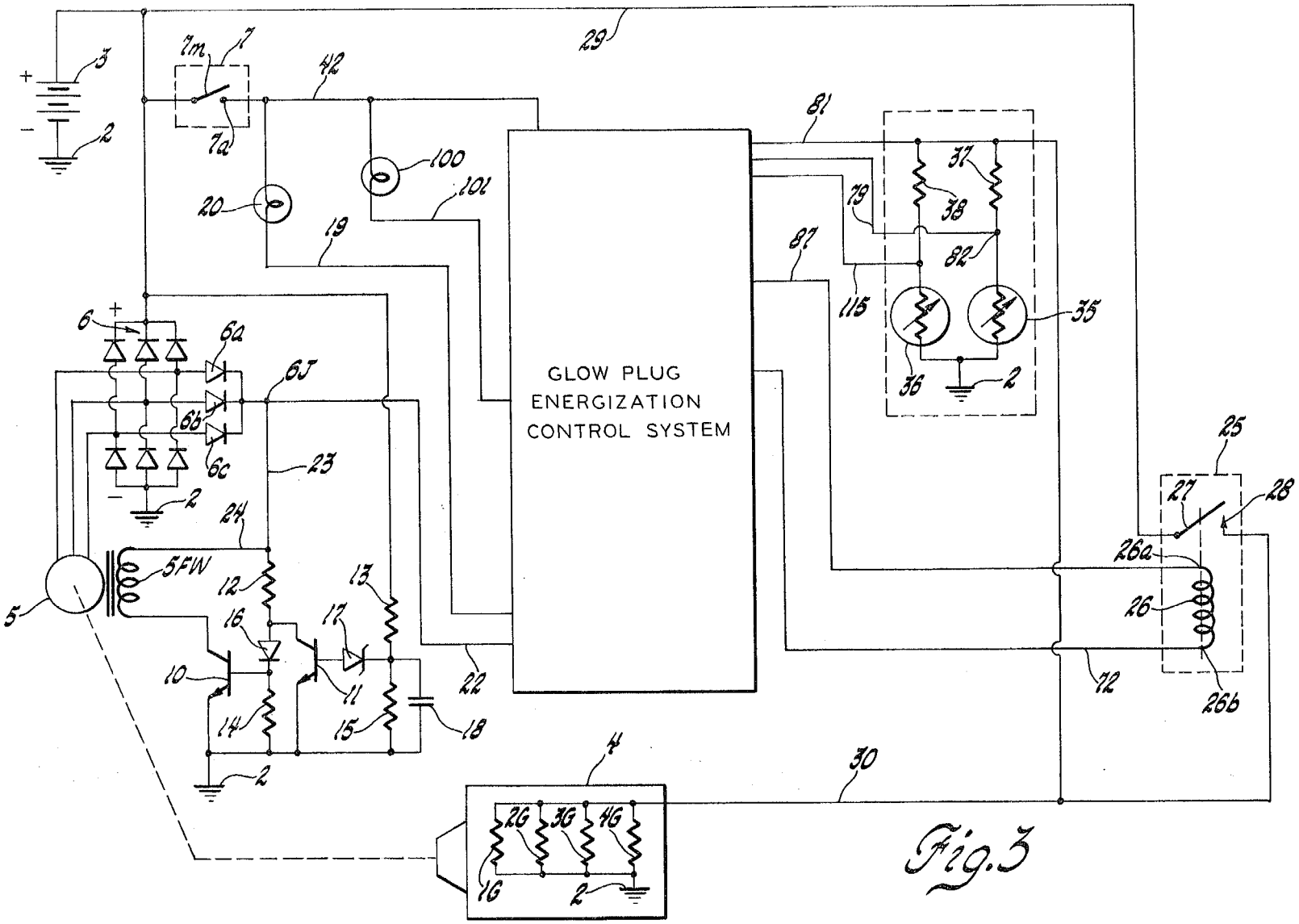

In FIGS. 1 and 2 of the drawing, the glow plug energization control system of this invention is set forth partially in schematic and partially in block form and in FIG. 3 of the drawing, the circuitry set forth in FIGS. 1 and 2 is represented by the block labeled "Glow Plug Energization Control System".

With reference to FIG. 3 of the drawing, the Diesel engine glow plug energization control system of this invention for cyclically completing and interrupting a glow plug energization circuit is illustrated in block form in combination with a circuit operating potential source, which may be a conventional automotive type storage battery 3, and a Diesel engine 4. The Diesel engine 4 is illustrated as having four glow plugs-1G, 2G, 3G and 4G-connected in parallel, each corresponding to a respective engine 4 combustion chamber. For purposes of this specification, the Diesel engine glow plug energization control system of this invention will be described with regard to a four-cylinder Diesel engine. It is to be specifically understood, however, that this system is also applicable to Diesel engines having more or less cylinders.

Diesel engine 4 is arranged to drive a conventional automotive-type alternator 5 in a manner well known in the art. The three-phase output potential of alternator 5 is full-wave rectified by a conventional six-diode bridge-type full-wave rectifier circuit 6 having a positive polarity output terminal connected to the positive polarity output terminal of battery 3 and a negative polarity output terminal connected to point of reference or ground potential 2.

The positive polarity output terminals of battery 3 and rectifier circuit 6 are connected to the movable contact *7m* of a conventional electrical switch 7 having, in addition to movable contact *7m*, a stationary contact *7a*. Movable contact *7m* and stationary contact *7a* may be the normally open ignition circuit contacts of a conventional automotive type ignition switch well known in the art or any other suitable single pole-single throw electrical switch.

In the interest of reducing drawing complexity, specific operating potential connections to the voltage comparator circuit elements of FIGS. 1, 2, 4, 6 and 7 have not been shown. It is to be specifically understood, however, that upon the closure of movable contact *7m* of electrical switch 7 to stationary contact *7a*, operating potential is supplied to these circuit elements as required.

Associated with full-wave rectifier circuit 6 is a diode trio *6a*, *6b*, and *6c*, that provides the energizing current for alternator field winding 5FW through the current-carrying electrodes of a switching NPN transistor 10 while this device is in the conductive mode. The circuitry including the switching NPN transistor 10, control NPN transistor 11, resistors 12, 13, 14 and 15, diode 16, Zener diode 17, and filter capacitor 18, is a conventional voltage regulator circuit of a type well known in the automotive art. Briefly, while the output potential of rectifier circuit 6 is of a level less than a predetermined magnitude, Zener diode 17 remains in the blocking state to maintain control NPN transistor 11 not conductive through the current-carrying elements thereof. While control NPN transistor 11 is not conductive, the potential across resistor 14 is of a magnitude sufficient to render switching NPN transistor 10 conductive through the collector-emitter electrodes thereof to complete an energizing circuit for field winding 5FW of alternator 5. Should the output potential of rectifier circuit 6 increase to a level substantially equal to or greater than the predetermined magnitude, Zener diode 17 breaks down and conducts in a reverse direction to render control NPN transistor 11 conductive through the collector-emitter electrodes thereof. While control NPN transistor 11 is conductive, base-emitter drive current is diverted from switching NPN transistor 10 to render this device not conductive, a condition that interrupts the alternator field winding 5FW energizing circuit.

Electric lamp 20 is the charge-indicator lamp well known in the automotive art that illuminates while movable contact *7m* of switch 7 is closed to stationary contact *7a* and alternator 5 is not charging battery 3. Upon the closure of movable contact *7m* of switch 7 to stationary contact *7a* while alternator 5 is not charging battery 3, such as when the engine 4 is not in the "Run" mode, an energizing circuit for charge-indicator lamp 20 is provided and may be traced from the positive polarity output terminal of battery 3, through the closed contacts of switch 7, charge-indicator lamp 20, lead 19, circuit point 19(2) of FIG. 2, diode 21, lead 22, circuit point 22(2), the FIG. 3 extension of lead 22, leads 23 and 24, alternator field winding 5FW, the collector-emitter electrodes of switching NPN transistor 10, and point of reference or ground potential 2, to the negative polarity output terminal of battery 3. Consequently, charge-indicator lamp 20 becomes illuminated to indicate that alternator 5 is not charging battery 3. While engine 4 is in the "Run" mode, the output potential of alternator 5 builds up, consequently the potential upon junction 6J increases to a magnitude substantially equal to that upon the positive output terminal of full-wave rectifier circuit 6. This potential, applied to the cathode electrode of diode 21 of FIG. 2, reverse-biases diode 21, consequently, charge-indicator lamp 20 extinguishes to indicate that alternator 5 is charging battery 3. If desired, the charge-indicator lamp 20 may be fused.

One way to reduce the time required for the glow plugs of a Diesel engine to be heated to the fuel ignition temperature is to energize the glow plugs with an operating potential source that is of a higher potential level than glow plug rated potential. Therefore, in the actual embodiment of the glow plug energization control system of this invention, the engine glow plugs are rated at six volts and are energized by an operating potential of the order to twelve volts. To prevent the destruction of the glow plugs as a result of overheating, therefore, it is necessary that the glow plugs by cyclically energized and deenergized in such a manner that the glow plugs are deenergized when they have become heated to the fuel-mixture ignition temperature but before they reach the destruction temperature.

To effect, respectively, the completion and interruption of the glow plug energizing circuit, an electrical relay 25, FIG. 3, having an operating coil 26 and movable and stationary electrical contacts 27 and 28, is provided. Upon the electrical energization of operating coil 26, movable contact 27 is operated into electrical circuit closing engagement with stationary contact 28 to complete an engine glow plug energizing circuit that may be traced from the positive polarity output terminal of battery 3, through lead 29, the closed contacts of relay 25, lead 30, the engine glow plugs 1G, 2G, 3G, and 4G in parallel, and point of reference or ground potential 2 to the negative polarity output terminal of battery 3.

In a manner to be explained later in this specification, the glow plug energization control system of this invention is operative to effect the energization of operating coil 26 of glow plug relay 25 to operate movable contact 27 into electrical circuit closing engagement with stationary contact 28 upon the initial application of operating potential and, thereafter, to effect the cyclical deenergization and energization of operating coil 26 in response to reference potential signals of respective predetermined magnitudes and externally generated switching signals.

Figure 9:
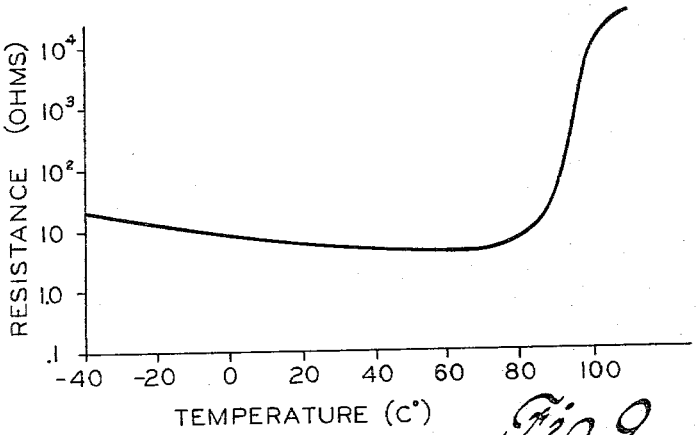
FIG. 9 is a typical resistance-temperature curve of a positive temperature coefficient resistor element suitable for use with the control system of this invention.
Figure 10:
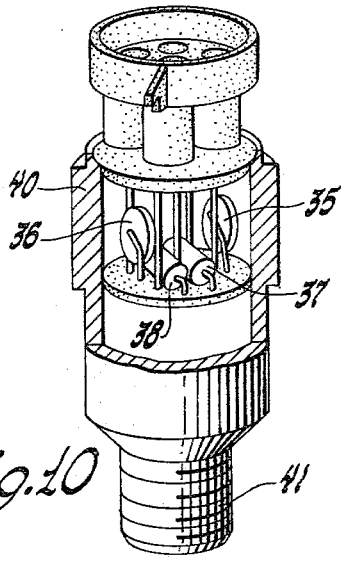
FIG. 10 is a perspective view partially in cut away of an engine probe suitable for use with the system of this invention.

To produce the externally generated switching signals in a manner to be later explained in detail, a primary positive temperature coefficient resistor element 35 is employed. Also in a manner to be later explained in detail, to provide glow plug protection in the event of a failure of primary positive temperature coefficient resistor element 35, a secondary positive temperature coefficient resistor element 36 is employed. To provide a current limit and an accurate calibration of primary and secondary positive temperature coefficient resistor elements 35 and 36, a resistor 37 is connected in series with primary positive temperature coefficient resistor element 35 and a resistor 38 is connected in series with secondary positive temperature coefficient resistor element 36. In the actual embodiment of the control system of this invention, primary and secondary positive temperature coefficient resistor elements 35 and 36 and respective series resistor elements 37 and 38 are mounted in an engine probe including a metal enclosure member 40, as illustrated in FIG. 10. Metal enclosure member 40 may be of brass or nickel-plated steel and is provided with a $\frac{3}{4}$-14 pipe thread 41 that is accommodated by a suitably threaded bore in the engine 4 cooling liquid jacket whereby the primary and secondary positive temperature coefficient resistor elements 35 and 36 mounted therein are in thermal-communication with engine 4 and, consequently, are sensitive to the temperature of engine 4. The required electrical connections to primary and secondary positive temperature coefficient resistor elements 35 and 36 and respective series resistor elements 37 and 38 may be made through suitable electrical connectors of any type well known in the art. The positive temperature coefficient resistor element as employed in this application is characterized by an extremely large resistance change in a small temperature span that may be as much as seven orders of magnitude over a 100° C. temperature span and exhibits an abrupt increase in resistance value when the temperature thereof reaches a predetermined switch temperature value. One example of a positive temperature coefficient resistor elements marketed by Keystone Carbon Company, Thermistor Division, St. Marys, Pa., under the designation RL 3006-50-90-25-PTO, having a switch temperature value of 90° C., were employed as primary and secondary positive temperature coefficient resistor elements 35 and 36. FIG. 9 of the drawing illustrates a typical resistance-temperature curve for positive temperature coefficient resistor elements of this type. The resistor elements employed in the actual embodiment exhibit a resistance value of the order of six ohms with temperatures less than the switch temperature and a resistance value of the order of thirty ohms at the switch temperature of 90° C. These elements are provided with electrical leads through which they may be connected to an external energizing circuit. As these elements are sensitive to both ambient temperature and to the heating effect produced by electrical current flow therethrough, primary and secondary positive temperature coefficient resistor elements 35 and 36 mounted within the metal enclosure member 40 that is screwed into the engine 4 cooling jacket are sensitive to both engine temperature and the self-heating effect as a result of electrical current flow therethrough.

In the following description of that portion of the Diesel engine glow plug energization control system of this invention set forth in FIG. 1, it will be assumed that the output NPN transistors of voltage comparator circuits 51, 52, 53, 54 and 55 of FIG. 2 are not conductive. In a manner to be explained later in this specification, voltage comparator circuits 51, 52, 53 and 54 are effective to disable the system in the event of a failure mode and voltage comparator circuit 55 effects the disabling of the system while engine 4 is in the "Run" mode.

Figure 4:
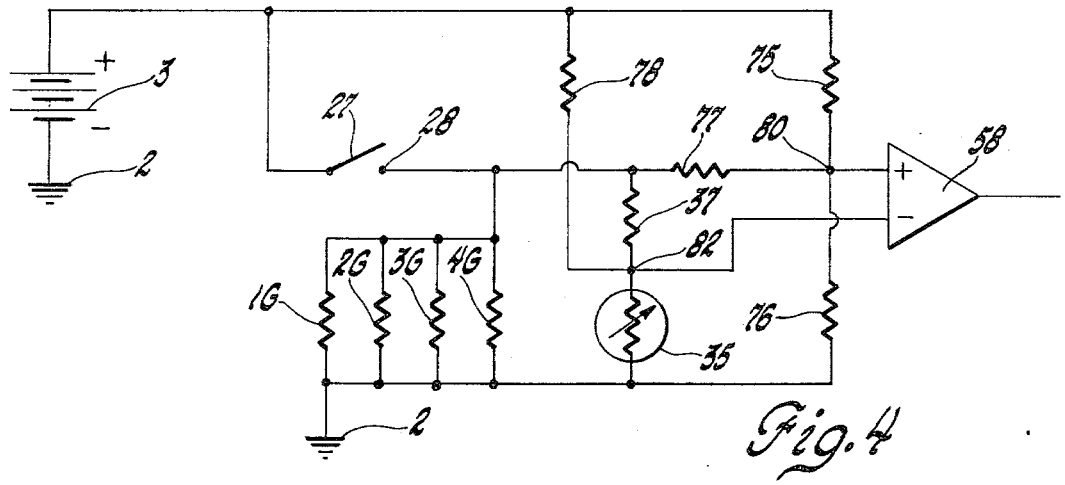
Figure 5:
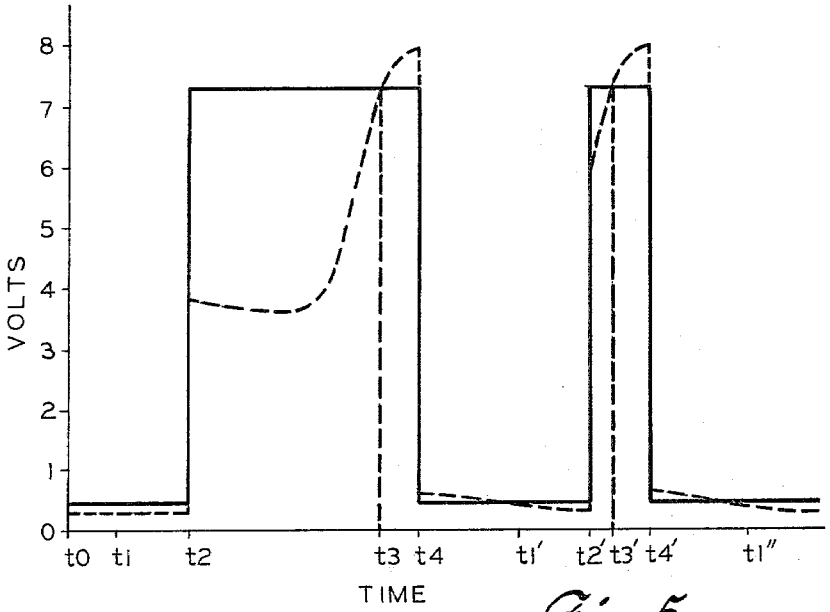

Upon the initial closure of electrical switch 7 of FIG. 3 at time t0 of FIG. 5, battery 3 operating potential appears across positive polarity potential lead 42 of FIG. 3, the FIG. 1 extension of positive polarity potential lead 42 through circuit point 42 (1), positive polarity potential leads 43 and 44 of FIG. 1, the FIG. 2 extension of positive polarity potential lead 42 through respective circuit points 42 (1*a*) and 42(2) of FIGS. 1 and 2 and positive polarity potential lead 45 of FIG. 2. As series resistors 46, 47, 48 and 49 of FIG. 2 are connected across positive polarity potential lead 45 and point of reference or ground potential 2, a reference potential signal of a predetermined magnitude appears upon junction 50 between series resistors 47 and 48 and is of a positive polarity upon junction 50 with respective point of reference or ground potential 2. In the actual embodiment, resistor 46 has a resistance value of 3.92 kilohms, resistor 47 has a resistance value of 0.392 of a kilohm, resistor 48 has a resistance value of 3.40 kilohms and resistor 49 has a resistance value of 1.0 kilohm. As a consequence, upon the initial closure of switch 7 of FIG. 3 at time t0 of FIG. 5, the reference potential signal present upon junction 50 is of the order of 4.6 volts. This reference potential signal is applied through lead 60, respective circuit points 60(2) and 60(1) of FIGS. 2 and 1 and the FIG. 1 extension of lead 60 to the plus (+) input terminal of voltage comparator circuit 56 and to the minum (−) input terminal of voltage comparator circuit 57. Because of capacitor 61 of FIG. 1 connected between junction 62 and point of reference or ground potential 2, the signal upon junction 62 is of a lower potential level than that of the signal applied to the minus (−) input terminal of voltage comparator circuit 57. As a consequence, voltage comparator circuit 57 is operated to the condition in which the output NPN transistor thereof is conductive to place the output terminal of this comparator circuit at substantially ground potential. With a substantially ground potential present upon the output terminal of voltage comparator circuit 57, the NPN transistor Darlington pair 63 is not conductive through the current carrying elements thereof. Therefore, as base drive current is supplied through resistor 73 to NPN transistor Darlington pair 64, this device prevents capacitor 61 from charging higher than the saturation voltage of this Darlington pair. This results in NPN transistor Darlington pair 63 being "locked" not conductive. At the same time, base drive current is supplied through resistor 67, leads 68 and 69 and resistor 70 to NPN transistor Darlington pair 71 to render this Darlington pair conductive through the current carrying elements thereof. Conducting NPN transistor Darlington pair 71 connects terminal end **26*b* of the glow plug relay 25 of the FIG. 3 to point of reference or ground potential 2 through lead 72, circuit point 72(1) of FIG. 1 and the FIG. 3 extension of lead 72. Also at this same time, resistor 75 is connected in series with the parallel combination of resistors 76 and 77. The terminal end of resistor 77 opposite that connected to junction 80 between resistor 75 and 76 is connected to point of reference or ground potential 2 through lead 81, circuit point 81(1) of FIG. 1, the FIG. 3 extension of lead 81, lead 30 and the parallel combination of glow plugs 1G, 2G, 3G and 4G of engine 4 to point of reference or ground potential 2. As the resistance value of this parallel combination of glow plugs is of the order of 0.075 of an ohm, this terminal end of resistor 77 is substantially connected to point of reference or ground potential 2 to place it in parallel with resistor 76 having the terminal end thereof opposite junction 80 connected directly to point of reference or ground potential 2. This is best seen in FIG. 4 wherein the circuit elements corresponding to the same circuit elements of FIG. 1 are assigned like characters of reference. As a consequence, a switch point reference potential signal of a potential level as determined by the ratio between the resistance values of resistor 75 and the parallel combination of resistors 76 and 77 appears upon junction 80 and is of a positive polarity upon junction 80 with respect to point of reference or ground potential 2. This switch point reference potential signal is applied to the plus (+) input terminal of control voltage comparator circuit 58. In the actual embodiment, resistor 75 has a resistance value of 14.3 kilohms, resistor 76 has a resistance value of 1.54 kilohms, and resistor 77 has a resistance value of 0.931 of a kilohm. As a consequence, the switch point reference potential signal upon junction 80 is of the order of 0.45 volts. The potential of battery 3 is applied through lead 42 of FIG. 1, resistor 78, lead 79, circuit point 79(1) of FIG. 1, and the FIG. 3 extension of lead 79 to the junction between resistor 37 and positive temperature coefficient resistor element 35. As the terminal end of resistor 37 opposite that connected to junction 82 between resistor 37 and positive temperature coefficient resistor element 35 is connected to point of reference or ground potential 2 through the parallel combination of the engine glow plugs 1G, 2G, 3G and 4G and since, as has previously been brought out, the resistance value of this parallel combination of glow plugs of the order of 0.075 of an ohm, this terminal end of resistor 37 substantially connected to point of reference or ground potential 2. Therefore, resistor 78 is connected in series with the parallel combination of positive temperature coefficient resistor element 35 and resistor 37. As a consequence, a switch reference potential signal of a potential level as determined by the ratio between the resistance values of resistor 78 and the parallel combination of positive temperature coefficient resistor element 35 and resistor 37 appears upon junction 82, is of a positive polarity with respect to point of reference or ground potential 2 and is applied to the minus (−) input terminal of control voltage comparator circuit 58. For purposes of this specification, it will be assumed that the ambient temperature with which the system is operating is within the range of 40°–70° C. Within this temperature range, the resistance value of positive temperature coefficient resistor element 35 is of the order of 6 ohms in the actual embodiment. Also in the actual embodiment, resistor 78 has a resistance value of 150 ohms and resistor 37 has a resistance value of 13 ohms. Therefore, the switch reference potential signal upon junction 82 is of the order of 0.3 volts. As the switch point reference potential signal present upon junction 80 and applied to the plus (+) input terminal of control voltage comparator circuit 58 is of a potential level higher than that of the switch reference potential present upon junction 82 and applied to the minus (−) input terminal of control voltage comparator circuit 58, the output NPN transistor of control voltage comparator circuit 58 is not conductive. With the output NPN transistor of control voltage comparator circuit 58 not conducting, base drive current is supplied from positive polarity potential lead 43 of FIG. 1, through series resistors 67 and 83, lead 84 and resistor 85 to NPN transistor Darlington pair 86 to render this device conductive through the current carrying elements thereof. Conducting NPN transistor Darlington pair 86 completes an energizing circuit for operating coil 91 of control relay 90 also having a normally open movable contact 92 and a stationary contact 93. This energizing circuit may be traced from positive polarity potential lead 43, through operating coil 91, conducting NPN transistor Darlington pair 86 and point of reference or ground potential 2 to the negative polarity output terminal of battery 3. Upon the energization of operating coil 91 of control relay 90 at time t1 of FIG. 5, movable contact 92 is operated into electrical circuit closing engagement with stationary contact 93. In the actual embodiment, the relay employed as control relay 90 has a "pull-in" time of the order of 15 milliseconds. Consequently, the period of time between the closure of switch 7 of FIG. 3 at time t0 of FIG. 5 and the closure of the control relay 90 contacts at time t1 of FIG. 5 is the "pull-in" time of control relay 90, of the order of fifteen milliseconds in the actual embodiment. Upon the closure of the contacts of control relay 90, an energizing circuit is completed for operating coil 26 of glow plug relay 25 of FIG. 3 through a circuit that may be traced from positive polarity potential lead 43 of FIG. 1, through the closed contacts of control relay 90, lead 87, circuit point 87(1) of FIG. 1, the FIG. 3 extension of lead 87, operating coil 26 of glow plug relay 25 from terminal end 26***a* to terminal end 26*b*, lead 72, circuit point 72(1) of FIG. 1, the FIG. 1 extension of lead 72, conducting NPN transistor Darlington pair 71 and point of reference or ground potential 2 to the negative polarity output terminal of battery 3. Diode 88 connected between circuit points 87(1) and 72(1) of FIG. 1 is the well known free wheeling diode for operating coil 26 of glow plug relay 25. Also upon the closure of the contacts of control relay 90, drive current is upplied to NPN transistor Darlington pair 95 of FIG. 1 through a circuit that may be traced from positive polarity potential lead 43, through the closed contacts of control relay 90, leads 96 and 97 and resistors 98 and 99. This drive current renders NPN transistor Darlington pair 95 conductive through the current carrying elements thereof to complete an energizing circuit for "Wait" lamp 100 of FIG. 3 through a circuit that may be traced from positive polarity potential lead 42 of FIG. 3, "Wait" lamp 100, lead 101, circuit point 101(1) of FIG. 1, the FIG. 1 extension of lead 101, conducting NPN transistor Darlington pair 95 and point of reference or ground potential 2 to the negative polarity output terminal of battery 3. Referring to FIG. 5, the switch point reference potential signal upon junction 80, illustrated by the solid lines of FIG. 5, and the switch reference potential signal upon junction 82, illustrated by the dashed lines of FIG. 5, remain substantially constant between times t0 and t1 with the switch reference potential signal being of a lower level than that of the switch point reference potential signal. Upon the energization of operating coil 26 of glow plug relay 25 of FIG. 3, movable contact 27 is operated into electrical circuit closing engagement with stationary contact 28 at time t2 of FIG. 5. In the actual embodiment, the relay employed as glow plug relay 25 has a "pull-in" time of the order of 50 milliseconds. Upon the closure of the glow plug relay 25 contacts at time t2 of FIG. 5, an energizing circuit for the four engine glow plugs in parallel is completed and may be traced from the positive polarity output terminal of battery 3, FIG. 3, through lead 29, the closed contacts of glow plug relay 25, lead 30, the four engine glow plugs in parallel and point of reference or ground potential 2 to the negative polarity output terminal of battery 3. As best seen in FIG. 4, also upon the closure of the glow plug relay 25 contacts, resistor 77 of FIGS. 1 and 4 is connected in parallel with resistor 75, this parallel combination is connected in series with resistor 76, resistor 37 is connected in parallel with resistor 78 and positive temperature coefficient resistor element 35 is connected in series with this parallel combination. Positive temperature coefficient resistor element 35 is energized by battery 3 through the parallel combination of resistors 37 and 78. The energizing circuit for positive temperature coefficient resistor element 35 may be traced from the positive polarity output terminal of battery 3 through two parallel branches. One of these branches is through lead 29 of FIG. 3, the contacts 27 and 28 of glow plug relay 25, leads 30 and 81 and resistor 37 to junction 82. The other of these branches may be traced from the positive polarity output terminal of battery 3 through lead 29 of FIG. 3, the contacts 7*m* and 7*a* of switch 7, lead 42, circuit point 42(1) of FIG. 1, the FIG. 2 extension of lead 42, resistor 78, lead 79, circuit point 79(1) and the FIG. 3 extension of lead 79 to junction 82. From junction 82, the energizing circuit may be traced through positive temperature coefficient resistor element 35 and point of reference or ground potential 2 to the negative polarity output terminal of battery 3. As the resistance value of the parallel combination of resistors 37 and 78 is much lower than the resistance value of resistor 78, 150 ohms Vs. 12 ohms, there is an increase of current flow through positive temperature coefficient resistor element 35. Referring to FIG. 5, the switch point reference potential signal upon junction 80 and the switch reference potential signal upon junction 82 remain substantially constant between times t1 and t2 with the switch reference potential signal being of a lower level than that of the switch point reference potential signal. As a result of the closure of the glow plug relay contacts at time t2 of FIG. 5, the four engine glow plugs are energized in parallel through the previously described energizing circuit and begin to increase in temperature and both the switch point reference potential signal upon junction 80 and the switch reference potential signal upon junction 82 increase in potential level as determined by the ratio of the resistance values of the parallel combination of resistors 75 and 77 and series resistor 76 and the ratio of the resistance values of the parallel combination of resistors 37 and 78 and series connected positive temperature coefficient resistor element 35, respectively. With the previously set forth resistance values of these resistors and resistor element in the actual embodiment, the potential level of the switch point reference potential signal upon junction 80 increases to a level of the order of 7.34 volts and the potential level of the switch reference potential signal upon junction 82 increases to a level of the order of 3.8 volts.

As a result of the self-heating effect as a result of increased current flow through positive temperature coefficient resistor element 35, the resistance value of this element begins to follow the typical resistance-temperature curve as set forth in FIG. 9 until, at time t3 of FIG. 5, it abruptly increases to a value at which the potential of the switch reference potential signal upon junction 82 is of a level substantially equal to that of the switch point reference potential signal upon junction 80. At this time the temperature of the four engine glow plugs has increased to the ignition temperature of the engine fuel mixture. In response to the potential level of the switch reference potential signal upon junction 82 at time t3, control voltage comparator circuit 58 operates to the condition in which the output NPN transistor thereof is conductive to place the output terminal thereof at substantially ground potential. With a substantially ground potential upon the output terminal of control voltage regulator circuit 58, NPN transistor Darlington pair 86, FIG. 1, is rendered not conductive to interrupt the previously energizing circuit for operating coil 91 of control relay 90. Positive temperature coefficient resistor element 35, therefore, is effective in response to the self-heating effect thereof while energized to establish a potential signal upon the minus (−) input terminal of control voltage comparator circuit 58 that attains a level substantially equal to that of the potential signal upon the plus (+) input terminal when glow plug temperature has increased to a predetermined value. As the positive temperature coefficient resistor element 35 is also responsive to engine temperature, the time required for it to reach the temperature at which the potential signal established thereby upon the minus (−) input terminal of control voltage comparator circuit 58 attains a level substantially equal to that of the potential signal upon the plus (+) input terminal, the switch temperature, is a function of engine temperature.

Upon the interruption of this energizing circuit, movable contact 92 of control relay 90 is released and operates out of electrical circuit closing engagement with stationary contact 93 at time t3 of FIG. 5. Upon the operation of movable contact 92 of control relay 90 out of electrical circuit closed engagement with stationary contact 93, the previously described energizing circuit for operating coil 26 of glow plug relay 25 of FIG. 3 is interrupted and drive current is removed from the NPN transistor Darlington pair 95 of FIG. 1. Upon the removal of this drive current, NPN transistor Darlington pair 95 is rendered not conductive to interrupt the previously described energizing circuit for "Wait" lamp 100, consequently, this lamp extinguishes and capacitor 103 begins to charge through resistor 102. In the actual embodiment, capacitor 102 charges to a potential level greater than that of the signal applied to the plus (+) input terminal of voltage comparator circuit 56 in approximately 200 milliseconds. As the charged upon capacitor 102 is applied to the minus (−) input terminal of voltage comparator circuit 56, this device operates to the condition in which the output NPN transistor thereof is conductive to place the output terminal thereof at substantially ground potential. With a substantially ground upon the output terminal of voltage comparator circuit 56, NPN transistor Darlington pair 95 is maintained not conductive and, consequently, the "Wait" lamp 100 energizing circuit is maintained interrupted until capacitor 103 discharges subsequent to the opening of switch 7 of FIG. 3. Zener diode 104 is a transient protection device for NPN transistor Darlington pair 95. Subsequent to the interruption of the energizing circuit for operating coil 26 of glow plug relay 25 the movable contact 27 operates out of electrical circuit engagement with stationary contact 28 at time t4 of FIG. 5, the previously described energizing circuit for the engine glow plugs is interrupted, resistor 77 is connected in parallel with resistor 76, as best seen in FIG. 4, and resistor 37 is connected in parallel with positive temperature coefficient resistor element 35 is previously described. This is true because the resistance value of the four engine glow plugs in parallel does not change appreciably at this elevated temperature. At this time, the switch point reference potential signal upon junction 80 reduces in potential level to that of the level of this signal between times t0 and t2, in the actual embodiment of the order of 0.45 volts. Also, the switch reference potential signal upon junction 82 reduces to a level as determined by the ratio of the resistance values of the parallel combination of positive temperature coefficient resistor element 35 and resistor 37 and resistor 78. As positive temperature coefficient resistor element 35 is at an elevated temperature at this time t4, this switch reference potential signal reduces to a level higher than that between times t0 and t2 as determined by the resistance value of positive temperature coefficient resistor element 35, of the order of 0.65 volts in the actual embodiment as the resistance value of the positive temperature coefficient resistor element 35 is of the order of 30 ohms at time t4. As the positive temperature coefficient resistor element 35 decreases in temperature, the switch reference potential signal upon junction 82 reduces in value as indicated by the dashed line of FIG. 5. In response to the switch reference potential signal attaining a level substantially equal to that of the switch point reference potential upon junction 80, control voltage comparator circuit 58 operates to the condition in which the output NPN transistor thereof is not conductive. With the output NPN transistor of control voltage comparator circuit 58 not conductive, drive current is supplied to NPN transistor Darlington pair 86, in a manner previously explained, to render this device conductive through the current carrying elements thereof. Conducting NPN transistor Darlington pair 86 completes the previously described energizing circuit for operating coil 91 of control relay 90 to operate movable contact 92 in electrical circuit closing engagement with stationary contact 93 at time t1′ of FIG. 5 energizing circuit for operating coil 26 of glow plug relay 25 of FIG. 3 is completed to operate movable contact 27 into electrical circuit closing engagement with stationary contact 28 at time t2′ of FIG. 5, the time between times t1′ and t2′ being the "pull-in" time for glow plug relay 25. As the engine glow plugs are deenergized between times t4 and t2′ of FIG. 5, the temperature of these devices decreases.

Upon the closure of the glow plug 25 relay contacts at time t2′, resistors 77 and 75 are again connected in parallel and in series with resistors 76 and resistors 37 and 78 are connected in parallel and in series with positive temperature coefficient resistor element 35, as previously described and best seen in FIG. 4. At this time, the switch point reference potential signal upon junction 80 increases to a level equal to that at time t2. However, since the positive temperature coefficient resistor element 35 is at an elevated temperature at this time t2′, the switch reference potential signal rises to a potential level as determined by the actual resistance value of positive temperature coefficient resistor element 35, of the order of 5.8 volts in the actual embodiment as indicated by FIG. 5. As the positive temperature coefficient resistor element 35 is at an elevated temperature at this time, less time is required for the resistance value thereof to increase along the typical resistance-temperature curve to a resistance value at which the switch reference potential signal on junction 82 is substantially equal to that of the switch point reference potential signal upon junction 80 at time t3′. Therefore, the glow plugs are energized for a shorter period of time. This cycle repeats until the engine is in the running mode at which time this portion of the control system is disabled in a manner to be later explained. With regard to FIG. 5, the times between t0 and t2 and between times t3 and t4 are exaggerated for the purpose of accurately illustrating the precise operation of this circuit.

Figure 6:
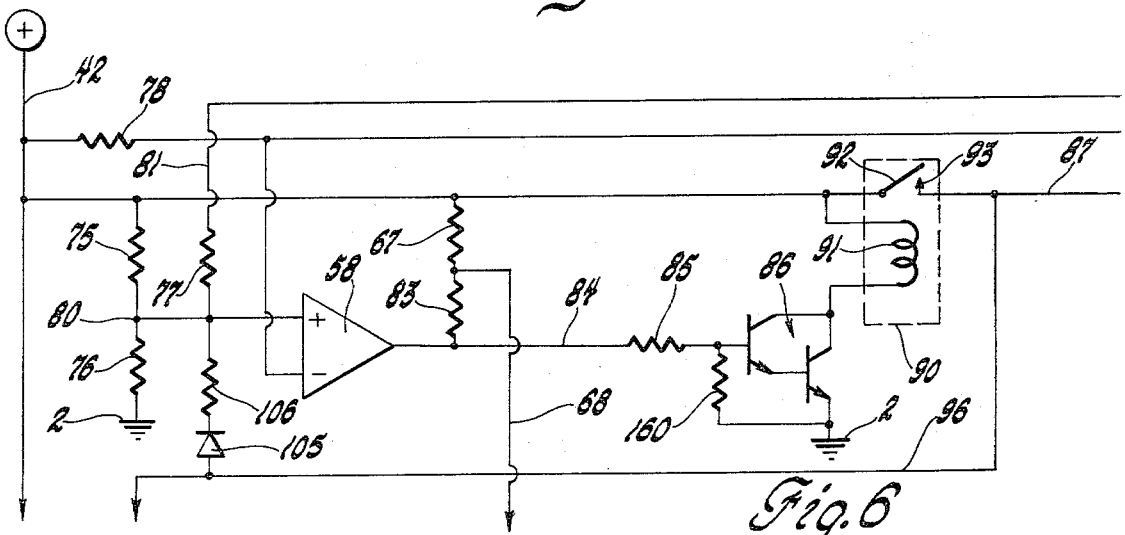
Figure 7:
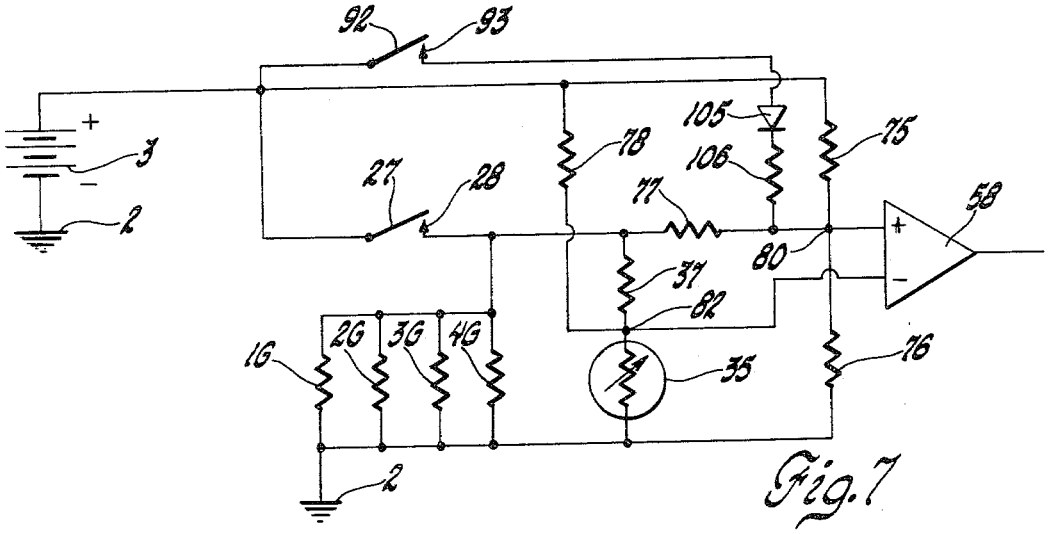

Referring to FIG. 5, the potential level of the switch point reference potential signal upon junction 80 is very near that of the switch reference potential signal upon junction 82 between times t0 and t2, of the order of 0.15 volts in the actual embodiment. With the potential level of these signals so close to each other, there is a possibility of spurious noise signals causing a malfunction of the cyclical switching cycle just described. To provide a measure of noise rejection if desired, the series combination of a diode 105 and a resistor 106 may be connected across stationary contact 93 of control relay 90 and junction 80 through lead 96, as illustrated in FIG. 6 that sets forth the pertinent portion of FIG. 1 and wherein the circuit elements corresponding to the same circuit elements of FIG. 1 are assigned like characters of reference. The significance of the addition of this series combination of diode 105 and resistor 106 is best illustrated in FIG. 7 wherein the circuit elements corresponding to the same circuit elements of FIG. 1 are assigned like characters of reference.

Figure 8:
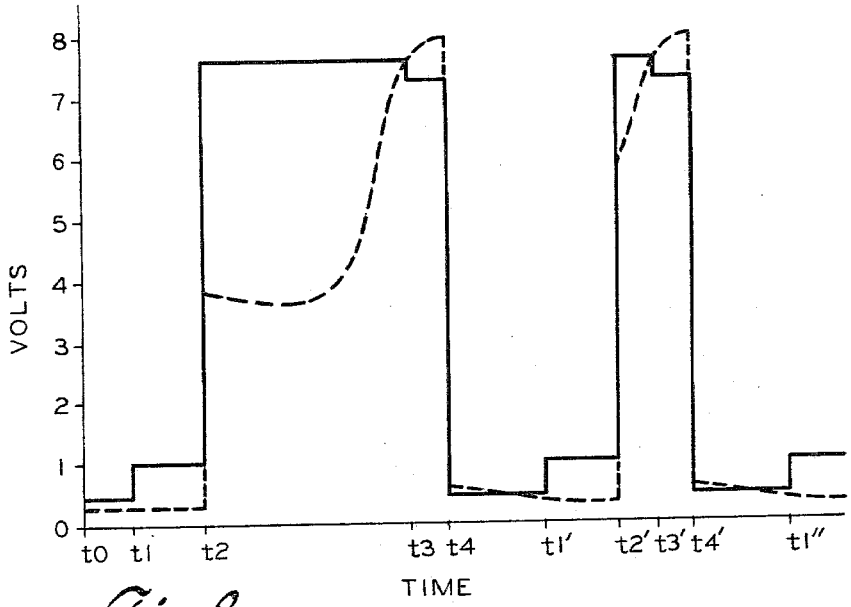
FIG. 8 is a set of curves useful in understanding the operation of the circuitry of FIGS. 1 and 6.

Upon the initial closure of electrical switch 7 of FIG. 3 at time t0 of FIG. 8, the previously described sequence of events occurs. During the "pull-in" time of control relay 90 between times t0 and t1 of FIG. 8, the contacts of both the control relay 90 and glow plug relay 25 are open. While the contacts of both the control relay 90 and the glow plug relay 25 are operated out of circuit closing engagement between time t0 and t1 of FIG. 8, resistor 77 is connected in parallel with resistor 76 and this parallel combination is connected in series with resistor 75 and resistor 37 is connected in parallel with positive temperature coefficient resistor element 35 and this parallel combination is connected in series with resistor 78 as previously described with regard to FIGS. 1 and 4. As a consequence, between times t0 and t1 of FIG. 8, the switch point reference potential signal appearing upon junction 80 and the switch reference potential signal appearing upon junction 82 is of the same level as previously described, 0.45 volts and 0.3 volts, respectively, in the actual embodiment. Upon the operation of movable contact 92 of control relay 90 into electrical circuit closing engagement with stationary contact 93 at time t1 of FIG. 8, the series combination of diode 105 and resistor 106 is connected in parallel with resistor 75 and this parallel combination is connected in series with the parallel combination of resistors 76 and 77. Therefore, upon the closure of the contacts 92 and 93 of the control relay 90 at time t1 of FIG. 8, the switch point reference potential signal upon junction 80 is of a potential level as determined by the ratio between the resistance values of the parallel combination of series connected diode 105 and resistor 106 in parallel with resistor 75 and the parallel combination of resistors 76 and 77. In the actual embodiment, the resistance value of resistor 106 is ten (10.0) kilohms which results in a switch point reference potential signal upon junction 80 of a level of the order of 1.03 volts disregarding the drop across diode 105 as shown at time t1 of FIG. 8. This provides a greater spread between the potential level of the switch point reference potential signal upon junction 80 and the switch reference potential signal upon junction 82. As the closed contacts 92 and 93 of control relay 90 at time t1 of FIG. 8, completes the previously described energizing circuit for operating coil 26 of glow plug relay 25, movable contact 27 of glow plug relay 25 is operated into electrical circuit closing engagement with stationary contact 28 at time t2 of FIG. 8 at the conclusion of the "pull-in" time for this relay, of the order of 50 milliseconds in the actual embodiment. Upon the closure of the glow plug relay contacts 27 and 28 at time t2 of FIG. 8, the parallel combination of resistors 75, 77 and series connected diode 105 and resistor 106 is connected in series with resistor 76. As a consequence, the switch point reference potential signal upon junction 80 rises to a level as determined by the ratio of the resistance values of this parallel combination and resistor 76. In the actual embodiment with the resistance values herein above set forth, the switch point reference potential signal appearing upon junction 80 at time t2 of FIG. 8 is of the order of 7.57 volts. Also upon the closure of the glow plug 25 relay contacts, the glow plugs are energized through the energizing circuit previously described and positive temperature coefficient resistor element 35 is energized through resistor 78 connected in series with positive temperature coefficient resistor element 35 and resistor 37 in parallel. As a consequence, both the glow plugs and positive temperature coefficient resistor element begin to heat as a result of the energizing current flow therethrough with the resistance value of positive temperature coefficient resistor element 35 increasing as indicated by the typical resistance-temperature curve of FIG. 9. With this increase in resistance value of positive temperature coefficient resistor element 35, the switch reference potential signal upon junction 82 increases in magnitude as shown between times t2 and t3 of FIG. 8. When the potential level of this signal reaches a level substantially equal to that of the switch point reference potential signal upon junction 80 at time t3 of FIG. 8, control voltage comparator circuit 58 is operated to the condition in which the output NPN transistor thereof is rendered conductive to place the output terminal of control voltage comparator circuit 58 at substantially ground potential. With a substantially ground potential upon the output terminal of control voltage comparator circuit 58, NPN transistor Darlington pair 86 is rendered not conductive to interrupt the previously described energizing circuit for operating coil 91 of control relay 90. Upon the deenergization of operating coil 91, movable contact 92 operates out of electrical circuit closed engagement with stationary contact 93 to interrupt the previously described energizing circuit for operating coil 26 of glow plug relay 25 and also disconnects the series combination of diode 105 and resistor 106. Upon the deenergization of operating coil 26 of glow plug relay 25 and between times t3 and t4 of FIG. 8 required for movable contact 27 of glow plug 25 to operate out of electrical circuit engagement with stationary contact 28, the switch point reference potential signal present upon junction 80 is of a potential level as determined by the ratio of the resistance values of parallel resistors 75 and 78 in series with resistor 76. As a resistance value of parallel resistors 75 and 78 increases upon the disconnection of series connected diode 105 and resistor 106, the switch point reference potential signal upon junction 80 reduces in value as indicated at time t3 of FIG. 8. In the actual embodiment, this switch point reference potential signal reduced to a level of the order of 7.35 volts. Upon the operation of movable contact 27 of glow plug relay 25 out of electrical circuit engagement with stationary contact 28 at time t4 of FIG. 8, resistor 77 is connected in parallel with resistor 76 as previously described and this parallel combination is connected in series with resistor 75 and resistor 37 is connected in parallel with positive temperature coefficient resistor element 35 as previously described and this parallel combination is connected in series with resistor 78. As these conditions are the same as at time t0, the switch point reference potential signal reduces to the same level as that between times t0 and t1. Also the switch reference potential signal upon junction 82 reduces to a level as determined by the ratio of the resistance values of the parallel combination of positive temperature coefficient resistor element 35 and resistor 37 and resistor 78. As positive temperature coefficient resistor element 35 is at an elevated temperature at this time t4, this switch reference potential signal reduces to a level higher than that between times t0 and t2 as determined by the resistance value of positive temperature coefficient resistor element 35, of the order of 0.65 volts in the actual embodiment as the resistance value of the positive temperature coefficient resistor element 35 is of the order of 30 ohms at time t4. As the positive temperature coefficient resistor element 35 decreases in temperature, the switch reference potential signal upon junction 82 reduces in value as indicated by the dashed line of FIG. 8. In response to the switch reference potential signal attaining a level substantially equal to that of the switch point reference potential upon junction 80, control voltage comparator circuit 58 operates to the condition in which the output NPN transistor thereof is not conductive. With the output NPN transistor of control voltage comparator circuit 58 not conductive, drive current is supplied to NPN transistor Darlington pair 86, in a manner previously explained, to render this device conductive through the current carrying elements thereof. Conducting NPN transistor Darlington pair 86 completes the previously described energizing circuit for operating coil 91 of control relay 90 to operate movable contact 92 in electrical circuit closing engagement with stationary contact 93 at time t1′ of FIG. 8. Upon the closure of the control relay 90 contacts, the switch point reference potential signal upon junction 80 increases as previously described with regard to time t1 and the previously described energizing circuit for operating coil 26 of glow plug relay 25 of FIG. 3 is completed to operate movable contact 27 into electrical circuit closing engagement with stationary contact 28 at time t2′ of FIG. 8, the time between times t1′ and t2′ being the "pull-in" time for glow plug relay 25. Upon the closure of the glow plug 25 relay contacts at time t2′, the switch point reference potential signal upon junction 80 increases to a level substantially equal to that at time t2 as previously described with regard to time t2. However, since the positive temperature coefficient element 35 is at an elevated temperature at this time t2′, the switch reference potential signal rises to a potential level as determined by the actual resistance value of positive temperature coefficient resistor element 35 of the order of 5.8 volts in the actual embodiment as indicated by FIG. 8. As the positive temperature coefficient resistor element 35 is at an elevated temperature at this time, less time is required for the resistance value thereof to increase along the typical resistance-temperature curve to a resistance value at which the switch reference potential signal on junction 82 is substantially equal to that of the switch point reference potential signal upon junction 80 at time t3′. Therefore, the glow plugs are energized for a shorter period of time. This cycle repeats until the engine is in the running mode at which time this portion of the control system is disabled in a manner to be later explained. With regard to FIG. 8, the times between t0 and t2 and between times t3 and t4 are exaggerated for the purpose of accurately illustrating the precise operation of this circuit.

For proper operation of this system in the manner hereinbefore explained, the positive temperature coefficient resistor element 35 is so selected relative to the glow plug characteristics that it establishes a potential level upon the second input terminal of control voltage comparator circuit 58 such that the potential level upon the first input terminal differs in a selected sense from that thereby established upon the second input terminal until glow plug temperature reaches at least an ignition temperature at which time the potential level thereby established upon the second input terminal attains a level substantially equal to that of the potential signal upon the first input terminal.

IN SUMMARY

I. The electrical switching arrangement including control voltage comparator circuit 58, glow plug relay 25 and control relay 90 has (1) first and second input terminals, the input terminals of comparator circuit 58, and is (2) operable to a first and to a second operating condition to effect, respectively, the completion and interruption of the engine glow plug energizing circuit in response, respectively, to a potential signal upon the first input terminal that is of a level that differs in a selected sense from that of a potential signal upon the second input terminal and to a potential signal upon the second input terminal that is of a level at least substantially equal to that of a potential signal upon the first input terminal.

II. The positive temperature coefficient resistor element 35 is (1) in thermal communication with associated engine 4, is (2) arranged for energization and deenergization simultaneously with glow plug energization and deenergization and is (3) effective in response to the self-heating effect thereof while energized and to engine temperature to establish a potential signal upon the second input terminal of the switching arrangement that attains a level substantially equal to that of the potential signal upon the first input terminal when the temperature of the resistor element has increased to a predetermined value.

III. Within the electrical switching arrangement:

1. Glow plug relay 25 and control relay 90 are switches that are electrically operable to a first and to a second operating condition; and
2. Control voltage comparator circuit 58 controls the glow plug relay and control relay in a manner to cyclically operate these devices to the first and second operating conditions in response to the signals applied to the plus (+) and minus (−) input terminals as set forth in paragraph I.

IV. The circuitry including resistors 75, 76 and 77 of one embodiment and additionally the series combination of diode 105 and resistor 106 of the alternate embodiment is adapted for connection across an energizing potential source and is, upon initial system energization, effective to establish a potential signal upon the first input terminal of the electrical switching arrangement that is of a first level that differs in a selected sense from that of the potential signal established upon the second input terminal by the positive temperature coefficient resistor element 35 and thereafter is effective upon the operation of the switching arrangement from the second to the first operating condition in response to these potential signals upon the first and second input terminals to establish a potential signal upon the first input terminal that is of a second level that differs by a greater magnitude of difference in the selected sense from that of the potential signal established by the resistor element 35 upon the second input terminal and is effective upon the operation of the switching arrangement from the first to the second operating condition in response to the potential signal established upon the second input terminal by the resistor element 35 having attained a level substantially equal to that of the potential signal upon the first input terminal when the temperature of the resistor element 35 has increased to a predetermined value or switch point to reestablish upon the first input terminal the potential signal of the first potential level.

With resistance values of 7.32 kilohms, 3.92 kilohms, 0.392 of a kilohm, 3.40 kilohms and 1.00 kilohm for respective resistors 34, 46, 47, 48 and 49 of FIG. 2 in the actual embodiment, and a supply potential of the order of 11.5 volts, upon the instant of closure of switch 7 of FIG. 3, a reference signal of a potential level of the order of 4.6 volts is present upon junction 50 as has been previously brought out, a reference signal of the order of 5.1 volts is present upon junction 110 and a reference signal of the order of 1.00 volts is present upon junction 111. Also at this time, the potential signal resulting from the flow of current through secondary positive temperature coefficient resistor element 36 is present upon junction 112 of FIG. 1. The circuit through which this current is supplied may be traced from positive polarity potential lead 42 of FIG. 1, through resistor 113, lead 115, circuit point 115(1) of FIG. 1, the FIG. 3 extension of lead 115, secondary positive temperature coefficient resistor element 36 and point of reference or ground potential 2 to the negative polarity output terminal of battery 3. Assuming the resistance values of resistor 113 and cold secondary positive temperature coefficient resistor element to be 150 and six ohms, respectively, the signal upon junction 112 is of the order of 0.44 volts. The reference signal upon junction 110 is applied to the plus (+) input terminal of comparator circuit 51, the reference signal upon junction 111 is applied to the minus (−) input terminal of comparator circuit 53 and the reference signal upon junction 112 of FIG. 1 is applied through lead 116 circuit points 116(1) and 116(2) of respective FIGS. 1 and 2 and the FIG. 2 extension of lead 116 to the minus (−) and plus (+) input terminals of respective voltage comparator circuits 51 and 52. Also at this time, because of the now forward biased base-collector diode of NPN transistor 71*a* of NPN Darlington pair 71 of FIG. 1, junction 117 is of a level substantially equal to the saturation voltage of NPN transistor Darlington pair 71, of the order of 0.7 volts in the actual embodiment, and junction 118 of FIG. 2 is at a voltage level substantially equal to the drop across alternator field winding 5FW and saturated switching transistor 10 of FIG. 3, of the order of 2.0 volts in the actual embodiment. Resistors 120 and 121 of FIG. 2 are of the same resistance value, 10 kilohms in the actual embodiment, and are connected in series across junction 117 of FIG. 1 and junction 118 of FIG. 2 as may be traced from junction 117, through lead 72 and circuit point 72(1), of FIG. 3 extension of lead 72, operating coil 26 of glow plug relay 25, lead 87, circuit point 87(1) of FIG. 1, the FIG. 1 extension of lead 87, lead 96, circuit points 96(1) and 96(2) of respective FIGS. 1 and 2, the FIG. 2 extension of lead 96 and resistors 120 and 121 in series to junction 18. As resistors 120 and 121 are of equal resistance values, the signal upon junction 122 therebetween is substantially one half the voltage across junctions 117 and 118, of the order of 1.35 volts in the actual embodiment, and is applied to the plus (+) input terminal of voltage comparator circuit 55. Referring to FIG. 2, resistors 125, 126 and 127 are connected in series across stationary contact 93 of control relay 90 of FIG. 1 and point of reference or ground potential 2 through lead 96, circuit points 96(1) and 96(2) of respective FIGS. 1 and 2, the FIG. 2 extension of lead 96 and lead 130. As the contacts 92 and 93 of control relay 90 are not closed at the instant of closure of switch 7 of FIG. 3, the signal upon each of junctions 128 and 129 between respective resistor pairs 125–126 and 126–127 is substantially zero. These signals are applied through respective leads 131 and 132 to the minus (−) input terminal of respective voltage comparator circuits 52 and 54.

Assuming there are no faults in the system, at the instant of closure switch 7 of FIG. 3 and until the contacts 92 and 93 of control relay 90 of FIG. 2 have "pulled-in":

1. Since the secondary positive temperature coefficient resistor element 36 is not overheated, the signal upon junction 110 of FIG. 2 is of a potential level higher than that of the signal upon junction 112 of FIG. 1 that are applied to the plus (+) and minus (−) input terminals, respectively, of voltage comparator circuit 51, consequently, the output NPN transistor thereof is not conductive;

2. Since the secondary positive temperature coefficient resistor element 36 is not shorted, the signal upon junction 112 of FIG. 1 is of a potential level higher than that of the signal upon junction 128 of that are applied to the plus (+) and minus (−) input terminals, respectively, of voltage comparator circuit 52, consequently, the output NPN transistor thereof is not conductive;

3. Since the alternator 5 is not shorted, the signal upon junction 122 of FIG. 2 is of a potential level higher than that of the signal upon junction 111 that are applied to the plus (+) and minus (−) input terminals, respectively, of voltage comparator circuit 53, consequently, the output NPN transistor thereof is not conductive;

4. As previously explained, the signal upon junction 117 of FIG. 1 that is applied through lead 135, circuit points 135(1) and 135(2) of respective FIGS. 1 and 2 and resistor 136 to the plus (+) input terminal of voltage comparator circuit 54 is of a potential level higher than that of the signal upon junction 129 that is applied through lead 132 to the minus (−) input terminal of voltage comparator circuit 54, consequently, the output NPN transistor thereof is not conductive; and 5. As the signal upon junction 50 is of a potential level higher than that of the signal upon junction 118 that are applied, respectively, to the plus (+) and minus (−) input terminals of voltage comparator circuit 55, the output NPN transistor thereof is not conductive.

When the contacts 92 and 93 operate electrically closed at the conclusion of the "pull-in" time of control relay 90 of FIG. 2, resistor 34 is connected in parallel with series resistors 46 and 47; series resistors 125, 126 and 127 of FIG. 2 are connected across positive polarity potential lead 43 of FIG. 1 and point of reference or ground potential 2 and series resistors 120 and 121 of FIG. 2 are connected across positive polarity potential lead 43 of FIG. 1 and junction 118 of FIG. 2. At this time, the signal upon junction 50 increases from a potential level of the order of 4.6 volts to a potential level of the order of 7.1 volts; the signal upon junction 110 increases from a potential level of the order of 5.1 volts to a potential level of the order of 7.5 volts; the signal upon junction 111 increases from a potential level of the order of 1.0 volts to a potential level of the order of 1.6 volts; with resistance values of 19.10 kilohms, 3.01 kilohms and 1.00 kilohm for respective series resistors 125, 126 and 127 of FIG. 2 and a supply potential of the order of 11.5 volts, a reference signal of a potential level of the order of 2.0 volts is present upon junction 128 and a reference signal of a potential level of the order of 0.5 volts is present upon junction 129 and the signal upon junction 122 increases from a potential level of the order of 1.35 volts to a potential level of the order of 6.75 volts. As the signal applied to the plus (+) input terminal of each of voltage comparator circuits 51, 53, 54 and 55 is still of a greater value than that of the signal applied to each of the minus (−) input terminals, these devices do not change state. However, the signal upon the plus (+) input terminal of voltage comparator circuit 52 is of a potential level less than that of the signal upon the minus (−) input terminal, consequently, the output NPN transistor is rendered conductive to place the output terminal at substantially ground potential. Therefore, the base electrode of NPN transistor 64*a* of NPN transistor Darlington pair 64 of FIG. 1 is substantially grounded through lead 140, circuit points 140(1) and 140(2) of respective FIGS. 1 and 2, the FIG. 2 extension of lead 140, lead 141 and the conducting output NPN transistor of voltage comparator circuit 52. As a consequence, NPN transistor Darlington pair 64 is rendered not conductive. However, capacitor 61 maintains a substantially ground potential upon junction 62 but begins to charge from positive polarity potential lead 42, through lead 44, diode 65 and resistor 66. The time constant of this RC circuit is such that capacitor 61 cannot charge to a potential level greater than that of the reference signal upon junction 50 of FIG. 2 that is applied through circuitry previously described to the minus input terminal of voltage comparator circuit 57 until the new energized glow plug relay 25 "pulls-in". When the contacts 27 and 28 of glow plug relay 25 operate closed, resistor 113 of FIG. 1 is connected in parallel with resistor 38 of FIG. 3 and this parallel combination is connected in series with secondary positive temperature coefficient resistor element 36. With a resistance value of 150 ohms, 13 ohms and 6 ohms for resistors 113 and 38 and secondary positive temperature coefficient resistor element 36, respectively, and a supply potential of the order of 11.5 volts the signal upon junction 112 of FIG. 2 increases from a potential level of the order of 0.44 volts to a potential level order of 3.84 volts. As this signal that is applied through circuitry previously explained to the plus (+) input terminal of voltage comparator circuit 52 is of a potential level greater than that of the signal applied to the minus (−) input terminal thereof, the output NPN transistor thereof is rendered not conductive to remove ground from the base of NPN transistor 64*a* of NPN transistor Darlington pair 64 of FIG. 1. This Darlington pair, therefore, is rendered conductive to discharge capacitor 61.

A failure mode that results (1) in the potential signal upon junction 112 increasing to a potential level greater than that of the signal upon junction 110 such as a primary positive temperature coefficient resistor element 35 or associated operating circuitry malfunction that results in secondary positive temperature coefficient resistor element 36 heating to its switch point or secondary positive temperature coefficient element 36 becoming open on line 115 becoming open or shorted to the battery; or that results (2) in the potential signal upon junction 112 decreasing to a potential level less than that upon junction 128 such as line 115 being shorted to ground or secondary positive temperature coefficient resistor element 36 being shorted to ground or resistor 38 being open; or that results (3) in the potential signal upon junction 117 decreasing to a potential level less than that of the signal upon junction 129 such as NPN transistor Darlington pair becoming shorted to ground or operating coil 26 of glow plug relay 25 becoming open or line 87 becoming open; or (4) should alternator 5 short, the output NPN transistor of respective voltage comparator circuits 51, 52, 54 and 53 would be rendered conductive to place substantially ground upon the base electrode of NPN transistor 64*a* of NPN transistor Darlington pair 64 of FIG. 1 to render this device not conductive. With NPN transistor Darlington pair 64 not conductive, capacitor 61 charges from positive polarity potential lead 42 through lead 44, diode 65 and resistor 66. When the charge upon capacitor 61 that is applied to the plus (+) input terminal of voltage comparator circuit 57 has increased to a potential level equal to or greater than that of the reference signal applied to the minus (−) input terminal, the output NPN transistor of voltage comparator circuit 57 is rendered not conductive. Upon this output NPN transistor going not conductive, drive current is supplied to NPN transistor Darlington pair 63 from positive polarity lead 42, through lead 44 and resistors 150 and 151 and drive current is further supplied through resistor 152 to NPN transistor Darlington pair 95 to render these Darlington pairs conductive. Conducting NPN transistor Darlington pair 63 drains drive current from NPN transistor Darlington pairs 64, 71 and 86 to render these devices not conductive and to "latch" these devices not conductive to effect the deenergization of operating coil 26 of glow plug relay 25 by removing ground from terminal end 26*b* and by deenergizing operating coil 91 of control relay 90. Conducting NPN transistor Darlington pair 95 completes the previously described energizing circuit for "wait" lamp 100 to indicate a fault has occurred.

One example of a failure mode that will effect this operation of each of voltage comparator circuits 51, 52, 53 and 54 to the operating condition in which the output NPN transistor is conductive is as follows:

1. Secondary positive temperature coefficient resistor element 36 is selected to substantially "track" but lag slightly behind primary positive temperature coefficient resistor element 35. In the event of a failure of this latter device, the potential signal across secondary positive temperature coefficient resistor element 36 appears upon junction 112 of FIG. 1 and increases in potential level as element 36 becomes heated. When this signal, that is applied to the minus (−) input terminal of voltage comparator circuit 51 of FIG. 2, has increased to a potential level substantially equal to that of the signal applied to the plus (+) input terminal of voltage comparator circuit 51, the output NPN transistor thereof is rendered conductive to place substantially ground upon the base of NPN transistor 64*a* of NPN transistor Darlington pair 64 of FIG. 1.

2. Should secondary positive temperature coefficient resistor element 36 become shorted, the signal upon junction 112 of FIG. 1, that is applied to the plus (+) input terminal of voltage regulator circuit 52 of FIG. 2, reduces to a potential level less than that of the signal applied to the minus (−) input terminal of voltage comparator circuit 52 to render the output NPN transistor thereof conductive. This conducting transistor places substantially ground upon the base of NPN transistor 64*a* of NPN transistor Darlington pair 64 of FIG. 1.

3. Should alternator 5 become shorted, the signal upon junction 122 of FIG. 2, that is applied to the plus (+) input terminal of voltage comparator circuit 53, reduces to a potential level less than that of the signal applied to the minus (−) input terminal of voltage comparator circuit 53 to render the output NPN transistor thereof conductive. This conducting transistor places substantially ground upon the base of NPN transistor 64*a* of NPN transistor Darlington pair 64 of FIG. 1.

4. Should NPN transistor Darlington pair 71 of FIG. 1 become shorted, the signal upon junction 117, that is applied to the plus (+) input terminal of voltage comparator circuit 54 of FIG. 2, reduces to a potential level less than that of the signal upon the minus (−) input terminal of voltage comparator circuit 54 to render the output NPN transistor conductive. This conducting transistor places substantially ground upon the base of NPN transistor 64*a* of NPN transistor Darlington pair 64 of FIG. 1.

As has been previously brought out, upon the initial closure of switch 7 of FIG. 3, junction 118 of FIG. 2 is at a potential level of the order of 2.0 volts and positive polarity potential lead 42 is connected to capacitor 147 through resistor 165 and isolating diode 146. Consequently, capacitor 147 begins to charge toward 2.0 volts through resistor 145 and diode 146. Resistor 165 and isolating diode 146 are not absolutely necessary but do tend to stabilize system operation in an automotive environment. When engine 4 is in the "Run" mode, junction 118 goes to substantially 11.5 volts, consequently, capacitor 147 charges more rapidly through resistor 145 toward 11.5 volts. The signal upon junction 148 follows and is one diode 146 drop higher than the charge potential upon capacitor 147. When the charge upon capacitor 147 increases to a potential level substantially equal to the potential level of the signal upon junction 50 less one diode 146 drop, voltage comparator circuit 55 is operated to the condition in which the output NPN transistor thereof is conductive. With this output NPN transistor conducting, substantially ground potential is placed upon the NPN transistor Darlington pair 86 input base electrode through resistor 85, leads 84 and 149, circuit points 149(1) and 149(2) of respective FIGS. 1 and 2, the FIG. 2 extension of lead 149 and the conducting output NPN transistor of voltage comparator circuit 55. This substantially ground potential signal prevents NPN transistor Darlington pair 86 from being rendered conductive, hence, the system is disabled while engine 4 is in the "Run" mode.

Capacitors 155 and 156 of FIG. 1 are filter capacitors, resistors 157 and 158 are bias resistors for NPN transistor Darlington pair 71, resistor 159 provides a discharge path for capacitor 61 when switch 7 is opened, resistor 160 is a bias resistor for NPN transistor Darlington pair 86, capacitor 161 is a filter capacitor and resistor 162 is a bias resistor for NPN transistor Darlington pair 64.

While a preferred embodiment of this invention has been shown and described, it will be obvious to those skilled in the art that various modifications and substitutions may be made without departing from the spirit of the invention that is to be limited only within the scope of the appended claims.

The embodiments of the invention in which an exclusive property or privilege is claimed are defined as follows:

1. A Diesel engine having at least one glow plug;

a source of glow plug energizing potential;

an electrical relay operable between first and second operating conditions to effect, respectively, the connection of said glow plug to and the disconnection of said glow plug from said energizing potential source;

a voltage comparator circuit having first and second input terminals effective to establish said first condition of operation in response to a potential level upon said first input terminal that differs in a selected sense from that upon said second input terminal and to establish said second condition of operation in response to a potential level upon said first input terminal that differs in an opposite sense from that upon said second input terminal;

a positive temperature coefficient resistor element in thermal communication with said engine arranged for energization simultaneously with glow plug energization and effective in response to the self-heating effect thereof while energized and to engine temperature to establish a potential level upon said comparator circuit second input terminal such that the potential level upon said first input terminal differs in said selected sense from that thereby established upon said second input terminal until glow plug temperature reaches at least an ignition temperature at which time the potential level thereby established upon said second input terminal attains a level substantially equal to that of the potential signal upon said first input terminal; and circuitry responsive to the operation of said relay from said first to said second operating condition to deenergize said positive temperature coefficient resistor element and said glow plugs for changing the potential level upon said comparator circuit first input terminal to such a value that the potential level thereupon differs in said opposite sense from that upon said second input terminal while said glow plug temperature decreases and responsive to the operation of said relay from said second to said first operating condition for changing the potential level upon said first input terminal to such a value that the potential level thereupon differs in said selected sense from that upon said second input terminal when said glow plug temperature has decreased to a pre-selected lower temperature that is still within the engine ignition range.

2. A Diesel engine glow plug energization control system for cyclically completing and interrupting a glow plug energizing circuit adapted for connection across an energizing potential source comprising:

an electrical switching arrangement including first and second input terminals that is operable to a first and to a second operating condition to effect, respectively, the completion and interruption to said glow plug energizing circuit in response, respectively, to a potential signal upon said first input terminal that is of a level that differs in a selected sense from that of a potential signal upon said second input terminal and to a potential signal upon said second input terminal that is of a level at least substantially equal to that of a potential signal upon said first input terminal;

a positive temperature coefficient resistor element in thermal communication with an associated engine arranged for energization and deenergization simultaneously with glow plug energization and deenergization and effective in response to the self-heating effect thereof while energized and to engine temperature to establish a potential signal upon said second input terminal of said switching arrangement that attains a level substantially equal to that of the potential signal upon said first input terminal when the temperature of said resistor element has increased to a predetermined value; and circuitry adapted for connection across an energizing potential source that, upon initial system energization, is effective to establish a potential signal upon said first input terminal of said electrical switching arrangement that is of a first level that differs in said selected sense from that of the potential signal established upon said second input terminal by said resistor element and thereafter is effective upon the operation of said switching arrangement from said second to said first operating condition in response to these potential signals upon said first and second input terminals to establish a potential signal upon said first input terminal that is of a second level that differs by a greater magnitude of difference in said selected sense from that of said potential signal established by said resistor element upon said second input terminal and is effective upon the operation of said switching arrangement from said first to said second operating condition in response to said potential signal established upon said second input terminal by said resistor element having attained a level substantially equal to that of said potential signal upon said first input terminal when the temperature of said resistor element has increased to said predetermined value to reestablish upon said first input terminal said potential signal of said first potential level.

3. A Diesel engine glow plug energization control system for cyclically completing and interrupting a glow plug energizing circuit adapted for connection across an energizing potential source comprising:

an electrical switching arrangement including first and second input terminals that is operable to a first and to a second operating condition to effect, respectively, the completion and interruption of said glow plug energizing circuit in response, respectively, to a potential signal upon said first input terminal that is of a level that differs in a selected sense from that of a potential signal upon said second input terminal and to a potential signal upon said second input terminal that is of a level at least substantially equal to that of a potential signal upon said first input terminal;

a positive temperature coefficient resistor element in thermal communication with an associated engine arrangement for energization and deenergization simultaneously with glow plug energization and deenergization and effective in response to the self-heating effect thereof while energized and to engine temperature to establish a potential signal upon said second input terminal of said switching arrangement that attains a level substantially equal to that of the potential signal upon said first input terminal when the temperature of said resistor element has increased to a predetermined value;

and circuit means including first and second resistors connected in series, a third resistor and said switching arrangement adapted for connection across said energizing potential source and interconnected in such a manner that said third resistor is connected in parallel with one of said first and second resistors while said switching arrangement is operated to said first operating condition and is connected in parallel with the other one of said first and second resistors while said switching arrangement is operated to said second operating condition; and means for connecting the junction between said first and second resistors to said first input terminal of said electrical switching arrangement.

4. A Diesel engine glow plug energization control system for cyclically completing and interrupting a glow plug energizing circuit adapted for connection across an energizing potential source comprising:

an electrical switching arrangement including first and second input terminals that is operable to a first and to a second operating condition to effect, respectively, the completion and interruption of said glow plug energizing circuit in response, respectively, to a potential signal upon said first input terminal that is of a level that differs in a selected sense from that of a potential signal upon said second input terminal and to a potential signal upon said second input terminal that is of a level at least substantially equal to that of a potential signal upon said first input terminal;

a positive temperature coefficient resistor element in thermal communication with an associated engine arranged for energization and deenergization simultaneously with glow plug energization and deenergization;

first circuit means including first and second resistors connected in series, a third resistor and said switching arrangement adapted for connection across an energizing potential source and interconnected in such a manner that said third resistor is connected in parallel with one of said first and second resistors while said switching arrangement is operated to said first operating condition and is connected in parallel with the other one of said first and second resistors while said switching arrangement is operated to said second operating condition;

second circuit means including a fourth resistor and said resistor element connected in series, a fifth resistor and said switching arrangement adapted for connection across an energizing potential source and interconnected in such a manner that said fifth resistor is connected in parallel with said fourth resistor while said switching arrangement is operated to said first operating condition and is connected in parallel with said resistor element while said switching arrangement is operated to said second operating condition;

means for connecting the junction between said first and second resistors to a selected one of said input terminals of said electrical switching arrangement; and means for connecting the junction between said fourth resistor and said resistor element to the other one of said input terminals of said electrical switching arrangement.

5. A Diesel engine glow plug energization control system for cyclically completing and interrupting a glow plug energizing circuit adapted for connection across an energizing potential source comprising:

switch means electrically operable to a first and to a second operating condition to effect, respectively, the completion and interruption of said glow plug energizing circuit;

a positive temperature coefficient resistor element in thermal communication with an associated engine arranged for energization and deenergization simultaneously with glow plug energization and deenergization;

first circuit means including first and second resistors connected in series, a third resistor and said switch means adapted for connection across an energizing potential source and interconnected in such a manner that said third resistor is connected in parallel with one of said first and second resistors while said switch means is operated to said first operating condition and is connected in parallel with the other one of said first and second resistors while said switch means is operated to said second operating condition;

second circuit means including a fourth resistor and said resistor element connected in series, a fifth resistor and said switch means adapted for connection across an energizing potential source and interconnected in such a manner that said fifth resistor is connected in parallel with said fourth resistor while said switch means is operated to said first operating condition and is connected in parallel with said resistor element while said switch means is operated to said second operating condition;

control means having first and second input terminals for cyclically operating said switch means to said first and second operating conditions in response, respectively, to a potential signal upon said first input terminal that is of a level that differs in a selected sense from that of a potential signal upon said second input terminal and to a potential signal upon said second input terminal that is of a level at least substantially equal to that of a potential signal upon said first input terminal;

means for connecting the junction between said first and second resistors to said first input terminal of said control means; and means for connecting the junction between said fourth resistor and said resistor element to said second input terminal of said control means.

* * * * *